US009920666B2

(12) United States Patent
Moetakef et al.

(10) Patent No.: US 9,920,666 B2
(45) Date of Patent: Mar. 20, 2018

(54) VANE OIL PUMP

(71) Applicant: Ford Global Technologies, LLC, Dearborn, MI (US)

(72) Inventors: Mohammad Ali Moetakef, West Bloomfield, MI (US); Abdelkrim Zouani, Canton, MI (US); Minghui Chien, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 240 days.

(21) Appl. No.: 14/868,818

(22) Filed: Sep. 29, 2015

(65) Prior Publication Data

US 2017/0089233 A1 Mar. 30, 2017

(51) Int. Cl.

| | |
|---|---|
| ***F04C 2/344*** | (2006.01) |
| ***F01M 1/02*** | (2006.01) |
| ***F04C 15/00*** | (2006.01) |
| *F04C 15/06* | (2006.01) |
| *F01C 21/08* | (2006.01) |

(52) U.S. Cl.

CPC ..... *F01M 1/02* (2013.01); *F04C 2/3442* (2013.01); *F04C 15/0049* (2013.01); *F01C 21/0818* (2013.01); *F01M 2001/0238* (2013.01); *F01M 2001/0246* (2013.01); *F04C 15/06* (2013.01); *F04C 2210/206* (2013.01);

(Continued)

(58) Field of Classification Search

CPC ..... F01M 1/02; F01M 2001/0238; F04C 15/0042; F04C 15/06; F04C 15/0061; F04C 2/102; F04C 15/0049; F04C 2210/206; F04C 2240/10; F04C 2240/20; F04C 2/3448

See application file for complete search history.

(56) References Cited

U.S. PATENT DOCUMENTS 3,007,419 A * 11/1961 Farlow ..... F04C 14/226 418/180
4,256,443 A * 3/1981 Kunze ..... F01C 1/3446 418/180

(Continued)

FOREIGN PATENT DOCUMENTS

| | | | |
|---|---|---|---|
| JP | 2004308605 | A | 11/2004 |
| JP | 2006200506 | A | 8/2006 |
| JP | 2014177902 | A | 9/2014 |

*Primary Examiner* — Mark Laurenzi
*Assistant Examiner* — Anthony Ayala Delgado
(74) *Attorney, Agent, or Firm* — Brooks Kushman P.C.; Greg Brown

(57) ABSTRACT

A vane fluid pump for a vehicle component is provided with an inner rotor supported within a cam. The inner rotor has an outer wall extending between first and second end faces, the outer wall defining a series of slots spaced apart about the outer wall to provide a series of outer wall sections. One of the wall sections defines a groove. Another of the wall sections is independent of grooves or is ungrooved. The pump has vanes positioned within respective slots of the inner rotor and extending outwardly to contact the continuous inner wall of the cam. The groove on the inner rotor is configured fluidly couple with a notch on the housing to provide fluid flow to the discharge port from an upstream pumping chamber to disrupt harmonics during operation to reduce pressure ripples and associated tonal noise.

14 Claims, 4 Drawing Sheets

(52) U.S. Cl.
CPC ..... *F04C 2240/20* (2013.01); *F04C 2270/13* (2013.01); *F04C 2270/14* (2013.01)

(56) References Cited

U.S. PATENT DOCUMENTS

| | | | | |
|---|---|---|---|---|
| 4,529,361 | A | 7/1985 | Sundberg | |
| 5,046,933 | A * | 9/1991 | Haga ..... | F04C 15/0049 418/133 |
| 6,877,969 | B2 | 4/2005 | Yao et al. | |
| 2009/0068049 | A1 | 3/2009 | Saito et al. | |
| 2014/0234150 | A1 | 8/2014 | Sugihara et al. | |
| 2015/0167608 | A1 | 6/2015 | Inose et al. | |

* cited by examiner

VANE OIL PUMP

TECHNICAL FIELD

Various embodiments relate to a vane oil pump for a powertrain component such as an internal combustion engine or a transmission in a vehicle.

BACKGROUND

An oil pump is used to circulate oil or lubricant through powertrain components such as an engine or a transmission. The oil pump is often provided as a vane pump. Vane pumps have a positive displacement characteristic and tight clearances between various components of the pump that result in the formation of pressure ripples or fluctuations of the fluid within the pump and the attached oil galleries during operation of the pump. The pressure ripples of the fluid generated by the pump may act as a source of excitation to powertrain components, for example, when the pump is mounted to the powertrain components. For example, the pump may be mounted to an engine block, a transmission housing, an oil pan or sump housing, a transmission bell housing, and the like, where the pressure ripples may cause tonal noise or whine from the engine or the transmission. This oil pump-induced powertrain whine or tonal noise is a common noise, vibration, and harshness (NVH) issue, and mitigation techniques may include countermeasures such as damping devices that are added to the powertrain to reduce noise induced by a conventional pump.

SUMMARY

In an embodiment, a vane fluid pump for a vehicle component is provided with a cam defining a continuous inner wall surrounding a cavity. An inner rotor is supported within the cam, and has a cylindrical outer wall extending between first and second end faces. The cylindrical outer wall defines a series of slots equally spaced about the outer wall to provide a series of outer wall sections with each outer wall section bounded by adjacent slots. A first wall section of the series of outer wall sections defines a groove. A second wall section of the series of outer wall sections is independent of grooves. A series of vanes is provided with each vane positioned within a respective slot of the inner rotor and extending outwardly to contact the continuous inner wall of the cam. The groove is configured to disrupt harmonics during operation to reduce pressure ripples and associated tonal noise.

In another embodiment, a vane pump is provided with a housing defining a notch connected to a discharge port. An inner rotor is eccentrically supported within a cam. The inner rotor has an outer perimeter defined by (n) wall sections separated by (n) axial slots, wherein between one and (n−1) wall sections each define a groove extending thereacross and configured to disrupt harmonics. The remaining wall sections are ungrooved. The pump has (n) vanes, each vane received by a respective axial slot.

In yet another embodiment, an inner rotor for a vane fluid pump is provided with a body having a series of side wall sections and a series of slots extending between first and second end faces. The side wall sections and the slots alternate about a perimeter of the body. One of the wall sections defines a groove. Another of the wall sections has a continuous smooth surface and is independent of grooves.

Various embodiments according to the present disclosure have associated, non-limiting advantages. For example, a vane oil pump may be provided with an inner rotor with the vanes being uniformly spaced about the rotor. One or more grooves may be provided on the outer wall of the inner rotor and between adjacent vanes, with an associated notch or slot on at least one of the pump body or cover. The notch or slot is in fluid communication with the pump outlet and is only in fluid communication with only the pumping chamber associated with a groove. By putting grooves on some segments of the rotor between the vanes, while leaving the remaining segments of the outer wall ungrooved, the main harmonics of the oil pump can be broken into lower peaks resulting in reduced pressure ripples and oil pump tonal noise.

DETAILED DESCRIPTION

Figure 1:
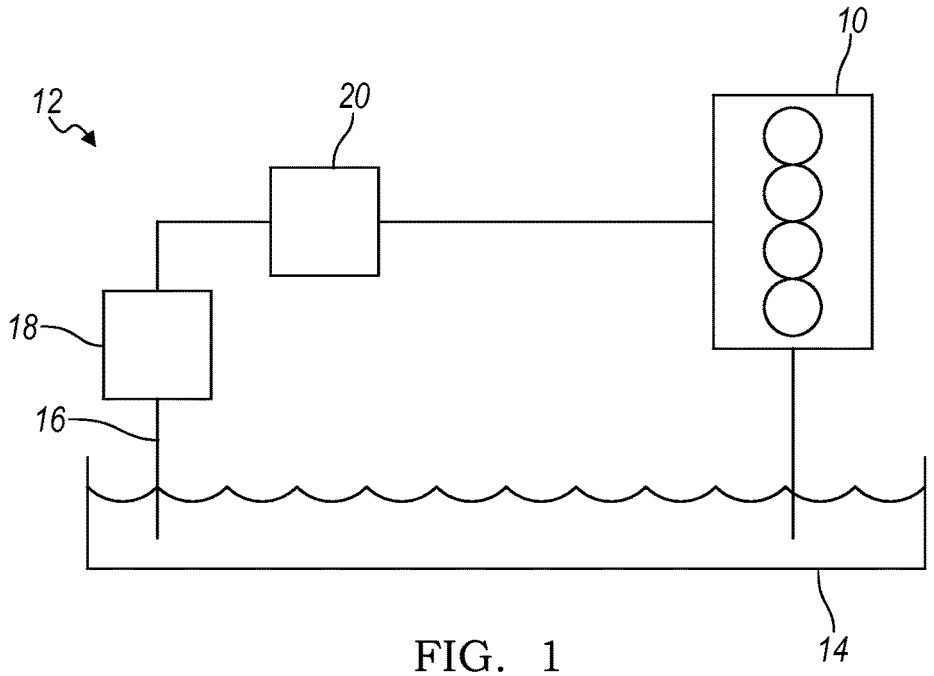
FIG. 1 illustrates a schematic of a lubrication system for an internal combustion engine in a vehicle according to an embodiment.

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

A vehicle component 10, such as an internal combustion engine or transmission in a vehicle, includes a lubrication system 12. The vehicle component 10 is described herein as an engine, although use of the system 12 with other vehicle components is contemplated. The lubrication system 12 provides a lubricant, commonly referred to as oil, to the engine during operation. The lubricant or oil may include petroleum-based and non-petroleum-synthesized chemical compounds, and may include various additives. The lubrication system 12 circulates oil and delivers the oil under pressure to the engine 10 to lubricate components in motion relative to one another, such as rotating bearings, moving pistons and engine camshaft. The lubrication system 12 may additionally provide cooling of the engine. The lubrication system 12 may also provide the oil to the engine for use as a hydraulic fluid to actuate various tappets, valves, and the like.

The lubrication system 12 has a sump 14 for the lubricant. The sump 14 may be a wet sump as shown, or may be a dry sump. The sump 14 acts as a reservoir for the oil. In one example, the sump 14 is provided as an oil pan connected to the engine and positioned below the crankshaft.

The lubrication system 12 has an intake 16 providing oil to an inlet of a pump 18. The intake 16 may include a strainer or filter and is in fluid contact with oil in the sump 14.

The pump 18 receives oil from the intake 16 and pressurizes and drives the oil such that it circulates through the system 12. The pump 18 is described in greater detail below with reference to FIGS. 2-6. In one example, the pump 18 is driven by a rotating component of the engine 10, such as a belt or mechanical gear train driven by the camshaft. In other examples, the pump 18 may be driven by another device, such as an electric motor.

The oil travels from the pump 18, through an oil filter 20, and to the vehicle component or engine 10. The oil travels through various passages within the engine 10 and then leaves or drains out of the engine 10 and into the sump 14.

The lubrication system 12 may also include an oil cooler or heat exchanger to reduce the temperature of the oil or lubricant in the system 12 via heat transfer to a cooling medium such as environmental air. The lubrication system 12 may also include additional components that are not shown including regulators, valves, pressure relief valves, bypasses, pressure and temperature sensors, and the like.

The pump 18 has a positive displacement along with tight clearances between various components that may result in the formation of excessive pressure ripples within the pump and the attached oil galleries. The pressure ripples of the pump when mounted on a vehicle component such as an engine block or a transmission housing may act as an excitation source to the various components, such as an oil pan, transmission bell housing, etc.

FIGS. 2-6 illustrate a pump 50 and various components thereof. The pump 50 may be used in the lubrication system 12 as pump 18.

Figure 2:
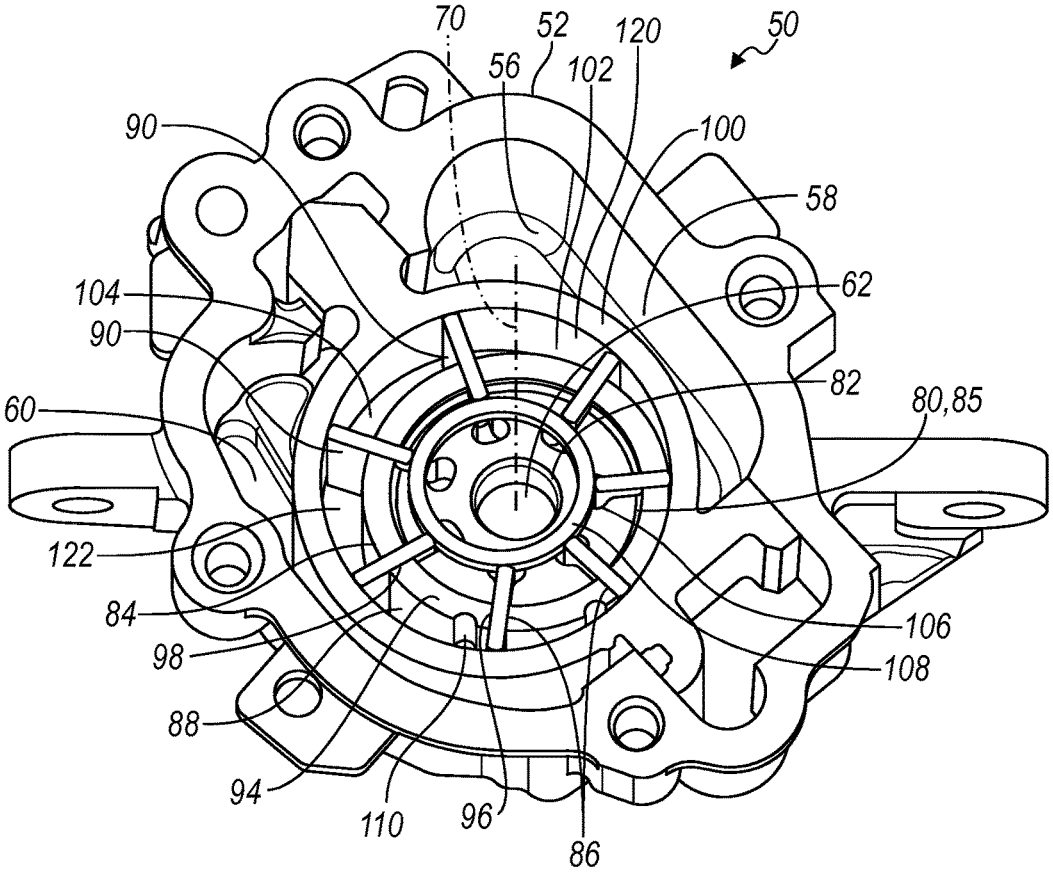
FIG. 2 illustrates a partial perspective view of a vane pump according to an embodiment.
Figure 3:
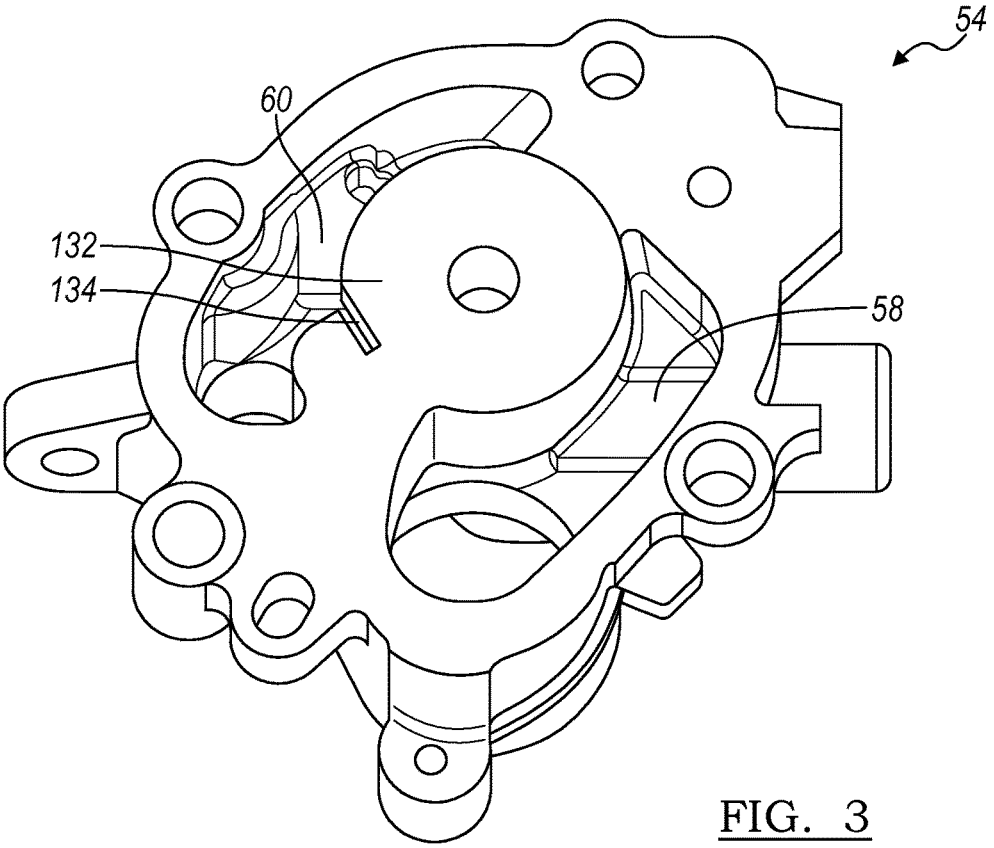
FIG. 3 illustrates a partial perspective view of a cover for the pump of FIG. 2.

Referring to FIGS. 2-3, the pump 50 is a vane pump, and is illustrated as being a sliding vane pump. In other examples according to the present disclosure the vane pump 50 may be other types of vane pumps including pendulum vane pumps, swinging vane pumps, etc.

The pump 50 has a housing 52 and a cover 54. The housing 52 and the cover cooperate to form an internal chamber 56. The cover connects to the housing 52 to enclose the chamber 56. The cover may attach to the housing 52 using one or more fasteners, such as bolts, or the like. A seal, such as an O-ring or a gasket, may be provided to seal the chamber 56.

The pump 50 has a fluid inlet 58 and a fluid outlet 60. The fluid inlet 58 has an inlet port that is adapted to connect to a conduit such as intake 16 in fluid communication with a supply, such as an oil sump 14. The fluid inlet 58 is fluidly connected with the chamber 56 such that fluid within the inlet 58 flows into the chamber 56. The cover 54 and/or the housing 52 may define portions of the inlet 58 region. The inlet 58 may be shaped to control various fluid flow characteristics.

The pump 50 has a fluid outlet 60 or fluid discharge that has an outlet port that is adapted to connect to a conduit in fluid communication with an oil filter, a vehicle component such as an engine, etc. The fluid outlet 60 is fluidly connected with the chamber 56 such that fluid within the chamber 56 flows into the outlet 60. The cover 54 and/or the housing 52 may define portions of the outlet 60 region. The outlet 60 may be shaped to control various fluid flow characteristics. The inlet 58 and the outlet 60 are spaced apart from one another in the chamber 56, and in one example, may be generally opposed to one another.

The pump 50 has a pump shaft or driveshaft 62 that is placed in aperture. The pump shaft is driven to rotate components of the pump 50 and drive the fluid. In one example, the pump shaft is driven by a mechanical coupling with an engine, such that the pump shaft rotates as an engine component such as a crankshaft rotates, and a gear ratio may be provided to provide a pump speed within a predetermined range. In one example, an end of the pump shaft is splined or otherwise formed to mechanically connect with a rotating vehicle component to drive the pump 50.

The other end of the shaft is supported for rotation within the cover 54 and housing 52 of the pump 50. The cover and housing may define supports for the end of the shaft to rotate therein. The support may include a bushing, a bearing connection, or the like. The shaft rotates about a longitudinal axis 70 of the shaft.

The shaft 62 extends through the housing 52, and the housing 52 defines an opening for the shaft to pass through. The opening may include a sleeve or a seal to retain fluid within the pump and prevent or reduce leakage from the chamber 56. The opening may also include additional bushings or bearing assemblies supporting the shaft for rotation therein.

An inner rotor 80 or inner gear is connected to the pump shaft 62 for rotation therewith. The inner rotor 80 has an inner surface or wall 82 and an outer surface or wall 84. The inner wall 82 is formed to couple to the pump shaft for rotation therewith about the axis 70. In one example, the inner wall 82 is splined to mate with a corresponding splined section of the pump shaft, and in another example, is press fit onto the shaft 62.

The outer wall 84 provides an outer circumference or perimeter of the inner rotor 80. In one example, the outer wall is cylindrical or generally cylindrical. In other examples, the outer wall 84 is provided by another shape. The outer wall 84 extends between opposed end faces 85 of the inner rotor 80.

The inner rotor 80 has a series of slots 86 and a series of outer wall sections 88, or side wall sections. In the example shown, the inner rotor has seven slots and seven outer wall sections. The rotor 80 may have two or more vanes and two or more corresponding outer wall sections in other examples. The slots 86 are spaced apart about the outer wall 84, and in one example, are equally spaced or spaced at equivalent angles about the inner rotor. The slots 86 define or provide the outer wall sections, as they divide the outer wall 84. Each outer wall section 88 is bounded by adjacent slots 86. The slots and outer wall sections alternate about a perimeter of the inner rotor. The outer walls sections 88 may lie about a perimeter of a common cylinder such that each outer wall section has a surface formed by a segment of a cylinder. For an inner rotor with equally spaced slots 86, each outer wall segment may have the same shape and size.

A series of vanes 90 is provided, with each vane positioned within a respective slot 86. Each slot 86 is sized to receive a respective vane. The vanes 90 are configured to slide within the slots 86. The vanes 90 and slots 86 may extend radially outward from the inner rotor 80 and axis 70, or may extend non-radially outwardly from the inner rotor 80.

Each outer wall section 88 extends between adjacent vanes 90. The inner rotor 80 rotates as the pump shaft 62 rotates. In the example shown, the inner rotor 80 rotates in a rotational direction, e.g. a counter-clockwise direction as shown in FIG. 2. Therefore, each outer wall section has an associated upstream edge adjacent to the upstream vane, and a downstream edge adjacent to the downstream vane. For example, wall section 94 has an upstream edge 96 and a downstream edge 98.

The pump 50 has a cam 100 that has a continuous inner wall 102. The cam 100 is supported within the internal chamber 56 of the housing 52. The cam 100 may have various protrusions or locating features that cooperate with the housing 52 to position and fix the cam 100 in the pump 50. The inner wall 102 may be a cylindrical shape as shown. The inner wall 102 defines a cavity 104. The inner rotor 80 and the vanes 90 are arranged and supported within the cavity 104 of the cam 100.

The inner rotor 80 may be eccentrically supported within the cam 100 such that the axis 70 of the inner rotor is offset from an axis of the cylindrical inner wall 102.

The vanes 90 extend outwardly from the inner rotor, and a distal end of each vane 90 is adjacent to and in contact with the inner wall 102 of the cam during pump operation. The inner rotor, the cam, and the vanes cooperate to form a plurality of variable volume pumping chambers to pump fluid from a fluid inlet 56 of the pump to a fluid outlet 60 of the pump. As the inner rotor 80 rotates, the spacing between the outer wall 84 of the inner rotor and the cam inner wall 102 changes at various locations around the cam 100. The chamber 120 formed by the inner rotor, vanes, and cam near the inlet port 58 increases in volume, which draws fluid into the chamber from the inlet port. The chamber 122 near the outlet port 60 is decreasing in volume, which forces fluid from the chamber into the discharge port and out of the pump.

The vanes 90 may slide outwardly during pump operation based on centrifugal forces to contact the inner wall of the cam and seal the variable volume chambers. In other examples, a mechanism such as a spring, or a hydraulic fluid, may bias the vanes outwardly to contact the cam inner wall.

The vanes 90 may include undervane passages 106 that act as back pressure chambers for pressure relief as the vane retracts. The inner rotor 80 may also include a vane ring 108 supported on one of the end faces 85 of the inner rotor 80 that prevents retraction of the vanes when the pump 50 is stopped and centrifugal forces on the vanes are absent. The proximal end of the vanes 90 abuts the vane ring 108.

FIG. 3 illustrates a cover 54 for the pump 50. The cover has an inlet chamber area 58 and an outlet chamber area 60. The cover has a surface 132. The surface 132 is generally planar and the inner rotor 80 is supported by the surface 132. The surface 132 may be shaped to extend between the inner edge of the inner wall 102 of the cam 100, and in other examples, extends outwardly past the inner edge of the inner wall of the cam about the inner wall. The distal ends of the vanes 90 of the inner rotor 80 do not extend past the surface 132 during pump 50 operation.

The surface 132 may include a timing notch or a slot 134. The slot 134 extends from a first location on the surface 132 to a second location at an edge of the surface. The first location may be an intermediate location on the surface 132. The first location is upstream of the second location. The slot 134 provides for fluid communication between an upstream chamber and the fluid outlet chamber of the pump 50 as described in further detail below with respect to FIGS. 5-6. The slot 134 is illustrated as having a linear shape, although other non-linear shapes are also contemplated. The slot 134 is illustrated as having a rectangular cross sectional shape; however, other cross section shapes are also contemplated.

Figure 4:
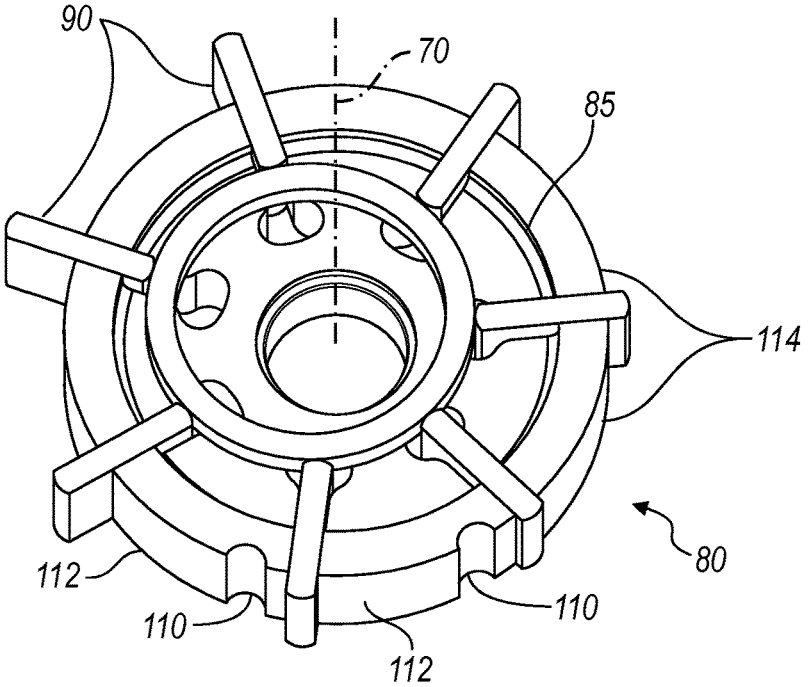
FIG. 4 illustrates a perspective view of an inner rotor for use with the vane pump of FIG. 2.

FIG. 4 illustrates an inner rotor for use with the pump 50. The inner rotor 80 has at least one groove 110 that is defined by one of the outer wall sections 112 of the series of outer wall sections. The rotor 80 may have more than one groove 110 as shown. The rotor 80 has (n) outer wall sections, has (n−1) or fewer wall sections that have associated grooves, and has 1 or more ungrooved wall sections. In the example shown, the rotor 80 has two grooves 110 with two different wall sections of the seven total wall sections. In another example, the rotor may have only one groove 110 on one wall section.

The groove 110 is a depression or other concave shape in the wall section that causes the volume of the chamber formed by that wall section to be greater than a volume of a chamber formed by an ungrooved wall section in the same rotational position in the pump. The groove 110 may extend across the outer wall section and from one end face to the other end face of the inner rotor 80. In one example, one end of the groove 110 intersects one end face 85, and the other end of the groove 110 intersects the opposed end face 85. In another example, the groove 110 intersects one end face 85 of the inner rotor 80 and extends only to an intermediate region of the wall section 110 of the inner rotor.

The groove 110 may be an axial groove, or a groove containing at least one directional component in the axial direction of the inner rotor. At least one of the remaining wall sections 114 of the series of wall sections is ungrooved or is independent of grooves. The groove 110 provides a different pumping chamber volume compared to an ungrooved wall section. The groove 110 provides for fluid communication between its associated pumping chamber and the notch and outlet chamber, and is configured to disrupt harmonics during operation of the pump 50 to reduce pressure ripples and associated tonal noise. By placing a groove on some, but not all, of the outer wall sections, the harmonics during pump operation are disrupted. The remaining wall sections 114 are ungrooved or independent of grooves such that they present a smooth, continuous outer surface. The remaining wall sections 114 may have a smooth continuous curved surface with a profile formed by an arc of a circle.

Note that a conventional inner rotor for a vane pump typically has all smooth, continuous, outer wall sections without grooves. Some conventional vane pumps may include grooves or other structures on the inner rotor; however, these grooves are uniformly spaced and positioned, and therefore are unable to disrupt or modify the pump harmonics. Other conventional vane pumps may include grooves or other features on the cam or on the pump housing. As these components do not rotate, they do not break down the pump harmonics and reduce pressure ripples and noise.

FIG. 4 illustrates the groove as extending in parallel with the axis 70 of the inner rotor 80. The positioning of the groove 110 on the wall section may vary. FIG. 4 also illustrates the groove 110 as being closer to an upstream vane, and farther from a downstream vane. In other examples, the groove 110 may be closer to a downstream vane and farther from an upstream vane, or may be positioned in a central location on the outer wall section. The location of the groove 110 may be additionally based on the design and position of the outlet port, as the two combined will affect the formation of pressure ripples.

In one example, the groove 110 is spaced a first distance from the upstream edge of the outer wall section and is spaced a second distance from the downstream edge of the outer wall section. In FIG. 4, the first distance is less than the second distance.

The groove 110 may be spaced apart from the edges of the outer wall section such that a portion of the outer wall section extends between the groove and the slot on either side of the groove. In other examples, the groove may intersect the slot.

In other examples, the groove 110 may extend across the inner rotor 80 at an angle relative to the axis 70 and the vanes 90. The groove 110 may be ten degrees, twenty degrees, thirty degrees, forty-five degrees, fifty degrees, sixty degrees, seventy degrees, eighty degrees, or at another angle relative to the axis 70. The groove may extend at a skew angle relative to a rotational axis of the inner rotor. The groove may be a linear groove, or may follow a helical or similarly shaped path.

FIG. 4 illustrates two grooves 110 on the inner rotor 80. The first and second grooves 110 may be similarly shaped and positioned on the outer wall sections. In other examples, the grooves 110 may be different shapes and/or at different positions on the outer wall sections. The grooves 110 are illustrated as being parallel to one another, and in other examples, are nonparallel.

The grooves 110 are shown in adjacent wall sections 112. In other examples, ungrooved wall sections 114 may be positioned between the grooved wall sections.

The wall sections are illustrated as each having a single groove, with other wall sections being ungrooved. In other examples, one wall section may have more than one groove extending across, while other wall sections remain ungrooved. If one wall section is provided with multiple grooves, the grooves may be of similar shape, size, orientation, or varying shape, size, and orientation.

The groove 110 may have a curved cross-sectional profile. In other examples, the groove 110 may be v-shaped, have chamfered edges, be formed from a complex shape such as one including both convex and concave regions, and the like. The groove may be the same shape and cross sectional areas along the length of the groove. In other examples, the groove 110 may change shape along the length of the groove, or may increase and/or decrease in cross-sectional area. The groove 110 is illustrated as having a uniform depth along the length of the groove. In other examples, the groove 110 may increase and/or decrease in depth along the length of the groove.

The groove 110 may extend linearly across the wall section as shown in FIGS. 2 and 4. In other examples, the groove may follow a curved path across the walls section, a linearly segmented path across the wall section, or other path across the wall section and between the opposed end faces of the inner rotor. The groove 110 may also be another shaped depression formed in the wall section surface.

Each groove 110 may be uniform along the length of the groove as shown. In alternative examples, the grooves 110 may have sections with increasing and/or decreasing tapered shapes along their length. The grooves 110 are illustrated as having a cross section formed as an arc or section of a circle. In other examples, the grooves 110 may have other cross sectional shapes including triangular, parabolic, other smooth continuous curves and/or linear discontinuous shapes. Each groove 110 is shown as being symmetrical; however, asymmetric grooves are also contemplated. The cross sectional shape of the groove 110 may be constant or may change along the length of the groove.

FIGS. 2-6 illustrate a vane pump with an inner rotor having an outer perimeter defined by (n) wall sections separated by (n) axial slots. Between one and (n−1) wall sections each define a groove on the outer perimeter extending axially thereacross and configured to disrupt harmonics, and each of these walls sections may define a single groove. The remaining wall sections are ungrooved. The inner rotor defines between one and (n−1) grooves extending axially across the outer perimeter, with each groove associated with a respective one and (n−1) wall section. The vane pump also has (n) vanes, each vane received by a respective axial slot. For example, if the inner rotor has (m) grooves where (m) is less than (n), one of the (m) wall sections is provided with one of the (m) grooves, and (n−m) wall sections are ungrooved.

In the present example, (n) is seven. FIGS. 2-6 illustrate two grooves, such that two wall sections defines two grooves extending axially across, while (n−2) wall sections are ungrooved.

As the pump 50 operates, pressure ripples of the fluid in the pump 50 may act as a source of excitation to powertrain components, for example, when the pump 50 is mounted to the powertrain components. For example, the pump 50 may be mounted to an engine block, a transmission housing, an oil pan or sump housing, a transmission bell housing, and the like, where the pressure ripples may cause tonal noise or whine from the engine or the transmission. The grooved inner rotor 80 design as shown in FIGS. 2-6 and according to the present disclosure acts to reduce or eliminate the oil pump-induced powertrain whine or tonal noise.

Figure 5:
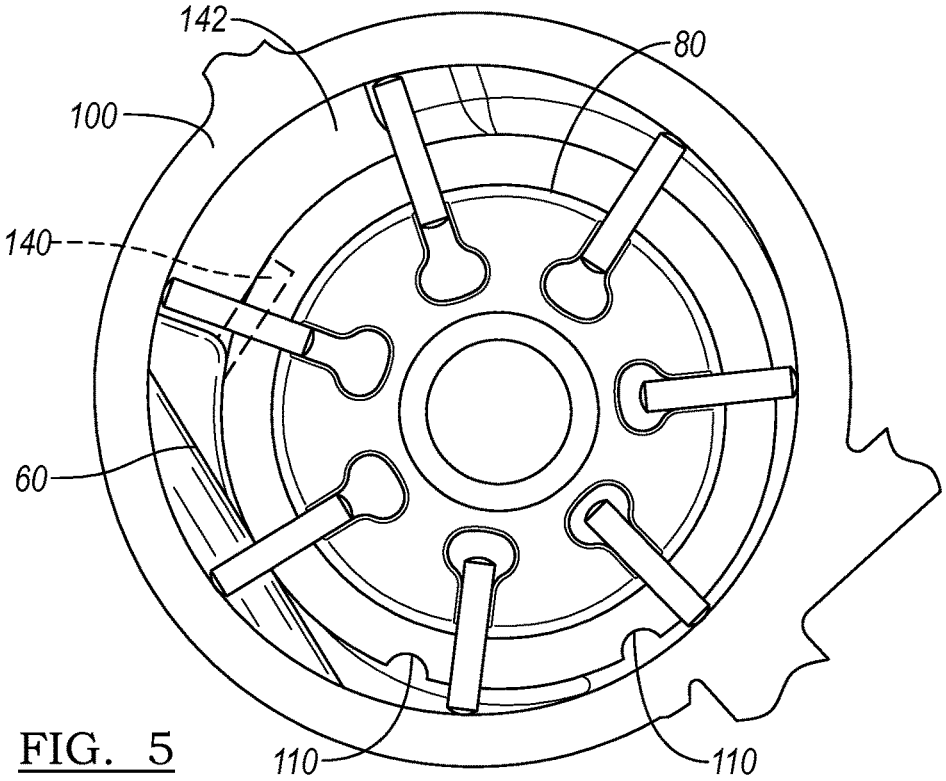
FIG. 5 illustrates a perspective schematic view of the pump of FIG. 2 with the rotor in a first position.

FIG. 5 illustrates the inner rotor 80 and the cam 100 with the inner rotor in a first rotational position in the pump. The body of the pump is provided with a surface defining a timing notch or slot 140. The slot 140 is similar to the slot as described above with respect to FIG. 3. The slot has a first end upstream of a second end, with the second end fluidly connected to the pump outlet 60. With the rotor 80 in the first position, the grooved sections are away from the notch 140. The surface of the rotor wall section blocks or prevents fluid in the pumping chamber 142 from entering the notch 140.

Figure 6:
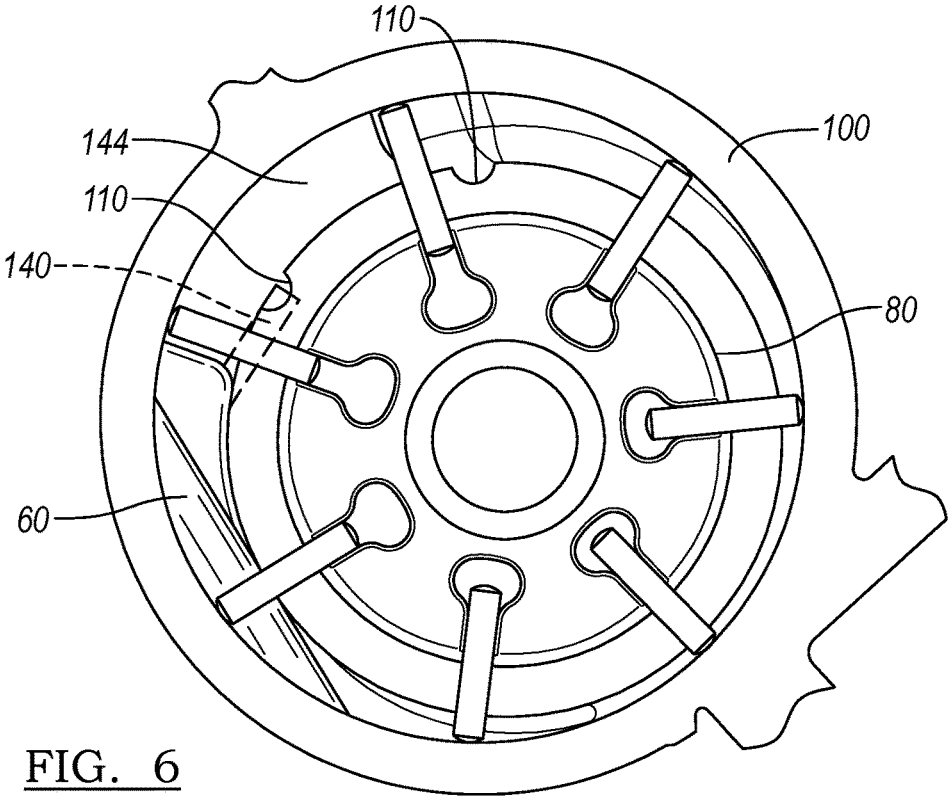
FIG. 6 illustrates a perspective schematic view of the pump of FIG. 2 with the rotor in a second position.

FIG. 6 illustrates the inner rotor 80 and the cam 100 with the inner rotor in a second rotational position in the pump. With the rotor 80 in the second position, one of the grooved sections is adjacent to the notch 140. The groove 110 provides a fluid connection or flow from the pumping chamber 144, into the notch 140 and to the outlet chamber 60. This acts to disrupt the pump harmonics as a small portion of fluid from an upstream chamber is flowing to the outlet chamber. As can be seen from the Figure, the groove 110 may in fluid communication with the notch for a predetermined number of degrees, for example, two, five, seven, ten, or other number of degrees of inner rotor 80 rotation.

FIG. 7 illustrates modeling and testing of the inner rotor 80 according to the present disclosure with improved pump operating characteristics compared to a conventional outer rotor. Modeling results are provided for a sliding vane pump 50 having the rotor 80, cover notch, and pump body notch as shown in FIGS. 2-6 and described herein, and the modeling illustrates the reduction in pressure ripples or spikes during operation compared to a conventional, ungrooved sliding vane pump. The grooves 110 act to break down the harmonics caused by the rotation of the inner rotor 80 and act to reduce the pressure ripples and reduce the tonal noise or whine.

Figure 7A:
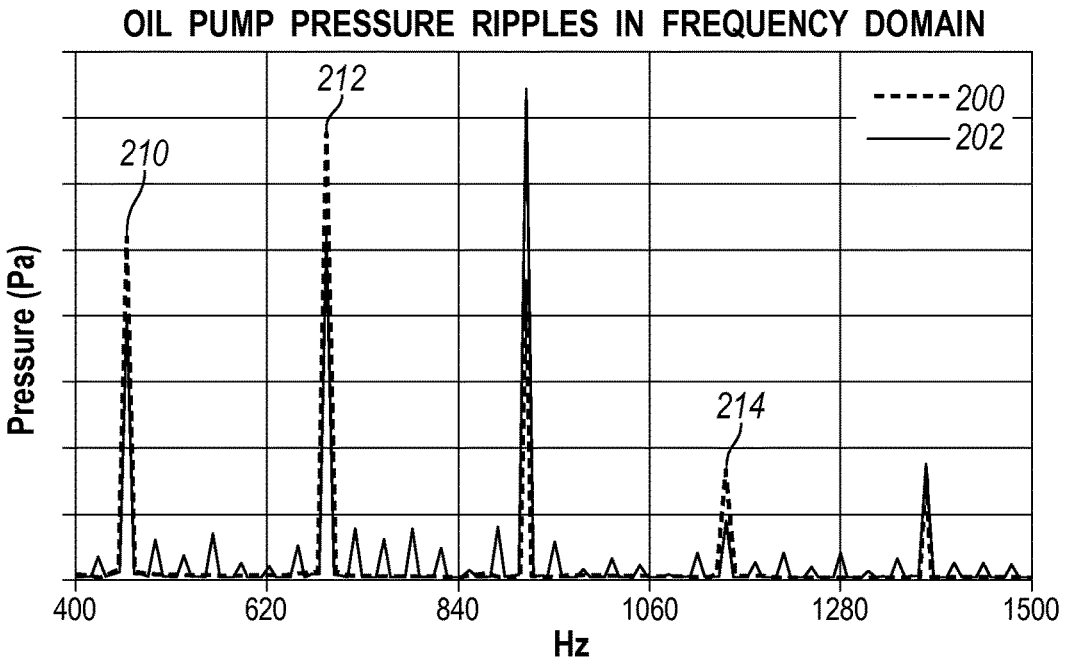
FIGS. 7A and 7B illustrate a frequency domain analysis for the pump of FIG. 2 with the inner rotor of FIG. 4 compared to a pressure output from a pump with a conventional, ungrooved inner rotor.
Figure 7B:
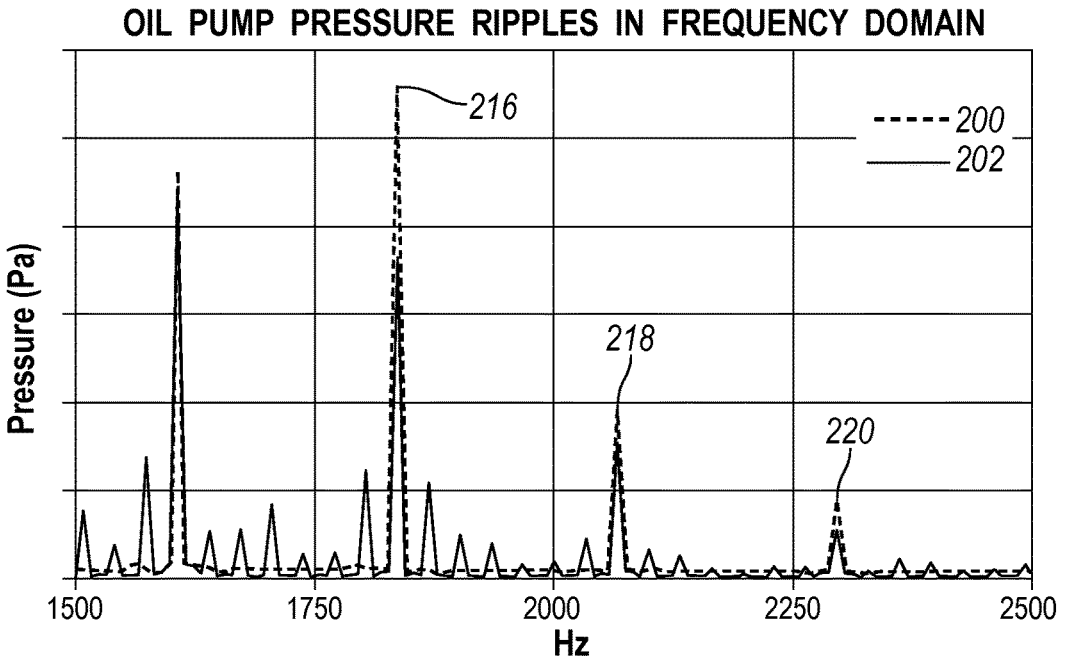

FIGS. 7A and 7B show the pressure ripples profiles in the frequency domain at the outlet of a vane pump with a seven vanes operating at 1970 rpm as determined using computational fluid dynamics (CFD) analysis. The fundamental frequency of the pump, i.e., 1st order, and the higher order harmonics are determined by the number of vanes. The inner rotor of the pumps has seven vanes, therefore, the harmonic orders of the pumps due to the pressure pulsations are multiples of 7 with the first order at 300 Hertz and the second order appearing at 460 Hertz.

From FIG. 7 in the frequency domain, the lower pressure amplitudes for orders beyond the fundamental orders may be seen, and is a typical characteristic of vane pumps. The tonal noise is usually due to the higher orders of the pump and reduction in amplitude for the first order which corresponds to the pump pressure ripples usually is not enough to resolve the whine issue. For a vehicle component oil pump NVH assessment, pump pressure fluctuations at higher frequency orders are therefore considered, and may be decreased to reduce tonal noise.

An analysis across a frequency domain showed a significant decrease in pressure peaks for the various orders of the pump 50, with the pressure peaks greatly reduced for the higher orders as shown in FIGS. 7A and 7B with a conventional pump illustrated by line 200, and a pump 50 according to the present disclosure illustrated by line 202.

For example, in FIG. 7A, at frequency 210, the pump 50 has approximately a 25% reduction in pressure compared to the conventional pump, has approximately a 30% reduction at frequency 212, and a 50% reduction at frequency 214. In FIG. 7B, at frequency 216, the pump 50 has approximately a 50% reduction in pressure compared to the conventional pump, has approximately a 20% reduction at frequency 218, and a 50% reduction at frequency 220. Note that pump 50 introduces side harmonics around the pump orders. The side peaks result in more uniformly distributed peaks in the frequency spectrum providing noise masking effect for tonal noise from the pump main orders.

The pump 50 according to the present disclosure additionally provides for decreased noise. For example, when the pump 50 according to the present disclosure is used with a powertrain for a vehicle the tonal noise from the powertrain is reduced. The tonal noise reduction using the pump 50 may provide for reduced NVH from the powertrain. Additionally, the powertrain or lubrication system may be simplified using a pump 50 according to the present disclosure. For example, the powertrain or lubrication system with a conventional pump may include noise reduction devices or features, and these features may be eliminated by switching to a pump according to the present disclosure. In one example, a conventional lubrication system includes a damping material such as a mastic located on the oil sump to reduce NVH caused by a conventional pump, and this damping material may be removed by switching to a pump 50 as described herein without an increase in tonal noise from the powertrain.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A vane fluid pump for a vehicle component comprising:

a cam defining a continuous inner wall surrounding a cavity;

an inner rotor supported within the cam, the inner rotor having a cylindrical outer wall defining a series of slots equally spaced about the outer wall to provide a series of outer wall sections, each outer wall section bounded by adjacent slots, wherein a first wall section of the series of outer wall sections defines a groove, wherein a second wall section of the series of outer wall sections is independent of grooves;

a series of vanes, each vane positioned within a respective slot of the inner rotor and extending outwardly to contact the continuous inner wall of the cam; and a pump housing supporting the cam, the inner rotor, and the series of vanes, and a pump cover, the pump cover defining a planar surface between an inlet port and a discharge port, the inner rotor supported by the planar surface, the planar surface defining a notch in fluid communication with the discharge port;

wherein the inner rotor, the cam, and the vanes cooperate to form a plurality of variable volume pumping chambers to pump fluid from a fluid inlet of the pump to a fluid outlet of the pump;

wherein the groove is configured to disrupt harmonics during operation to reduce pressure ripples and associated tonal noise;

wherein the groove and the notch cooperate to provide a fluid connection between the pumping chamber associated with the groove and the discharge port; and wherein the notch is otherwise covered by the inner rotor to prevent fluid flow through the notch to the discharge port.

2. The pump of claim 1 wherein the notch extends from the discharge port to an upstream location on the planar surface.

3. The pump of claim 1 wherein the groove on the first wall section is the only groove on the series of outer wall sections.

4. The pump of claim 1 wherein the first wall section has upstream and downstream edges formed by the slots on either side of the first wall section;

wherein the upstream and downstream edges are further defined by a rotational direction of the inner rotor; and wherein the groove is spaced a first distance from the upstream edge and is spaced a second distance from the downstream edge.

5. The pump of claim 4 wherein the first distance is less than the second distance.

6. The pump of claim 1 wherein the groove extends in parallel with a rotational axis of the inner rotor.

7. The pump of claim 1 wherein the groove extends linearly across the first wall section and between opposed end faces.

8. The pump of claim 1 wherein the groove is a first groove; and wherein a third wall section of the series of outer wall sections defines a second groove.

9. The pump of claim 8 wherein the first wall section and the third wall section are adjacent to one another.

10. The pump of claim 1 further comprising a drive shaft coupled for rotation with the inner rotor; and wherein the continuous inner wall of the cam is cylindrical; and wherein the inner rotor is eccentrically supported within the cam.

11. The pump of claim 1 wherein each vane is slidably received by the respective slot of the inner rotor.

12. The pump of claim 1 further comprising a vane ring positioned on an end face of the inner rotor;

wherein an inner end of each vane abuts the vane ring such that the vane ring is configured to prevent retraction of the vanes in the slots.

13. A pump comprising:

a housing having a planar surface defining a notch connected to a discharge port;

an inner rotor, supported by the planar surface and eccentrically supported within a cam, the inner rotor having an outer perimeter defined by "n" wall sections separated by "n" axial slots receiving "n" vanes, respectively;

wherein the inner rotor defines between one and "n−1" wall sections each having a groove, the remaining wall sections being ungrooved;

wherein the groove and the notch overlap to provide a fluid connection between the pumping chambers associated with the groove and the discharge port; and wherein the notch is otherwise covered by the inner rotor to prevent fluid flow through the notch to the discharge port.

14. The vane pump of claim 13 wherein the notch extends from an intermediate region of a planar surface to the discharge port, the planar surface supporting the inner rotor for rotation thereon.

* * * * *